United States Patent [19]

Gunther, Jr.

[11] 4,069,011

[45] Jan. 17, 1978

[54] ENVELOPE OPENING MACHINE

[75] Inventor: William H. Gunther, Jr., Guilford, Conn.

[73] Assignee: Thor Dahl, Inc., New York, N.Y.

[21] Appl. No.: 680,741

[22] Filed: Apr. 27, 1976

[51] Int. Cl.[2] ..... F24J 3/00

[52] U.S. Cl. ..... 432/230; 432/5; 432/231

[58] Field of Search ..... 432/5, 6, 12, 230, 231; 34/150

[56] References Cited

U.S. PATENT DOCUMENTS

| | | | |
|---|---|---|---|
| 720,669 | 2/1903 | Chapin | 34/150 |
| 1,677,492 | 7/1928 | Ritter | 432/230 |
| 1,834,567 | 12/1931 | Winkler et al. | 34/150 |
| 3,816,213 | 6/1974 | Whitman | 229/85 X |

*Primary Examiner*—John J. Camby

*Attorney, Agent, or Firm*—Holland, Armstrong, Wilkie & Previto

[57] ABSTRACT

A machine for opening envelopes by heat process which have been previously treated with chemicals.

38 Claims, 9 Drawing Figures

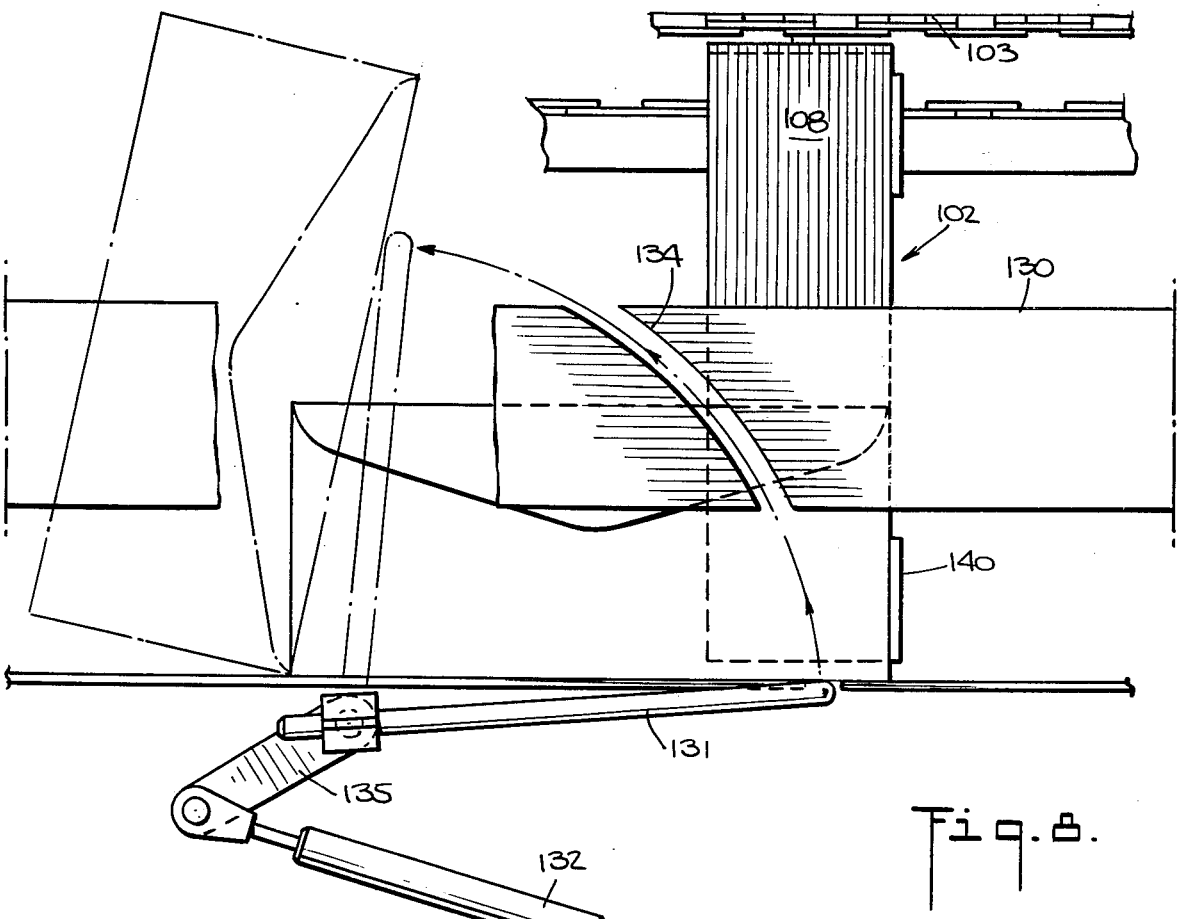
Fig. 8.
Fig. 9.
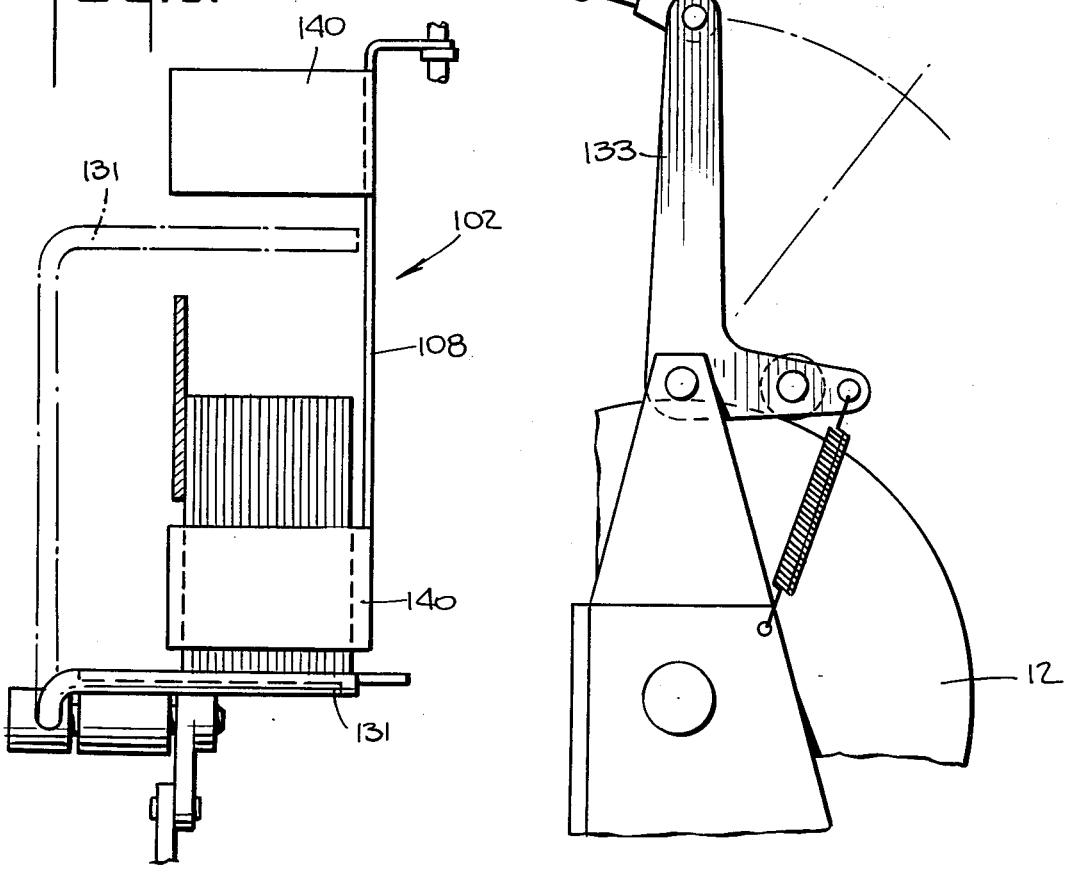

ENVELOPE OPENING MACHINE

DESCRIPTION

The present invention comprises an envelope opening machine and more particularly an improved machine for chemically opening envelope.

The present invention is an improvement over U.S. Pat. Nos. 3,677,460 and 3,816,213 owned by the assignee hereof. This application is also an improvement over application Ser. No. 599,596 filed July 28, 1975 which describes a method of opening an envelope and which the machine of the present invention is intended to perform.

As described in said patents and patent application, three sides of an envelope are subjected to a sensitizing agent, such as a sodium sulphate and thereafter (when the envelope is to be opened), the three sides are subjected to a developing agent such as an acid, in order to deteriorate the paper along the three edges upon the application of heat.

One of the difficulties in applying heat to the three edges is the fact that the envelopes cannot tolerate too much heat. On the other hand, there must be sufficient heat in order to permit the two chemicals to react and deteriorate the paper.

The present invention has for one of its objects the provision of an improved mechanism of applying sufficient heat to the edges of the envelope without deteriorating the contents thereof nor burning the envelope.

Another object of the present invention is a provision of improved mechanism of opening an envelope which will open envelopes continuously.

Another object of the present invention is a provision of improved mechanism of opening an envelope which will permit heat to be applied positively to the three edges of the envelope.

Another object of the present invention is the provision of an improved envelope opening mechanism which permits envelopes to be opened in continuous fashion.

Other and further objects of the present invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein:

FIG. 8 is an enlarged detail showing the raising means.

FIG. 9 is an end view of the mechanism shown in FIG. 8.

Figures 1, 2, 3:
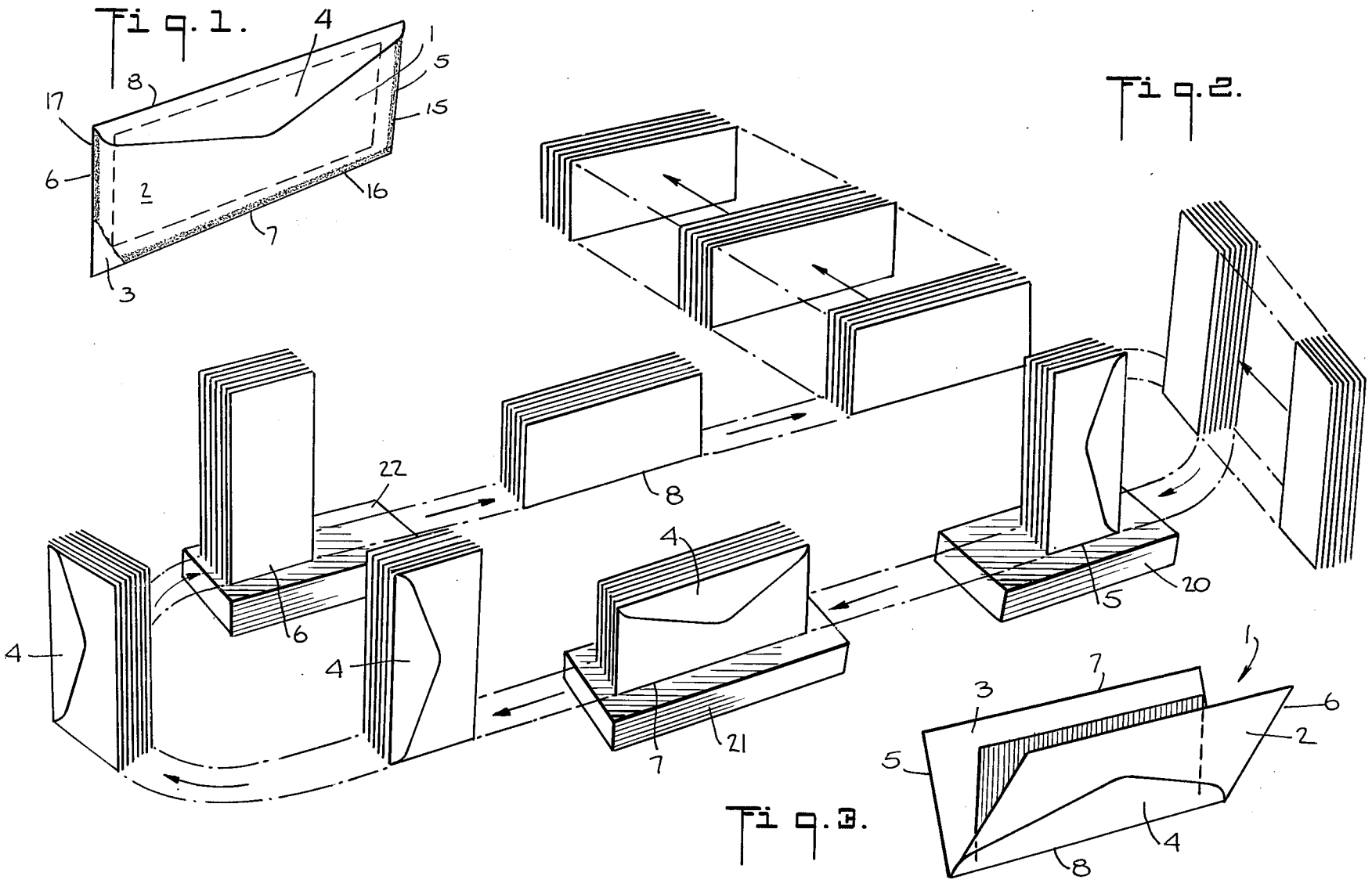
FIG. 1 is a perspective view of an envelope which is to be used in connection with the present invention.
FIG. 2 is a diagrammatic perspective view of the mechanism of the present invention.
FIG. 3 is a perspective view showing the opened envelope.
Figure 4:
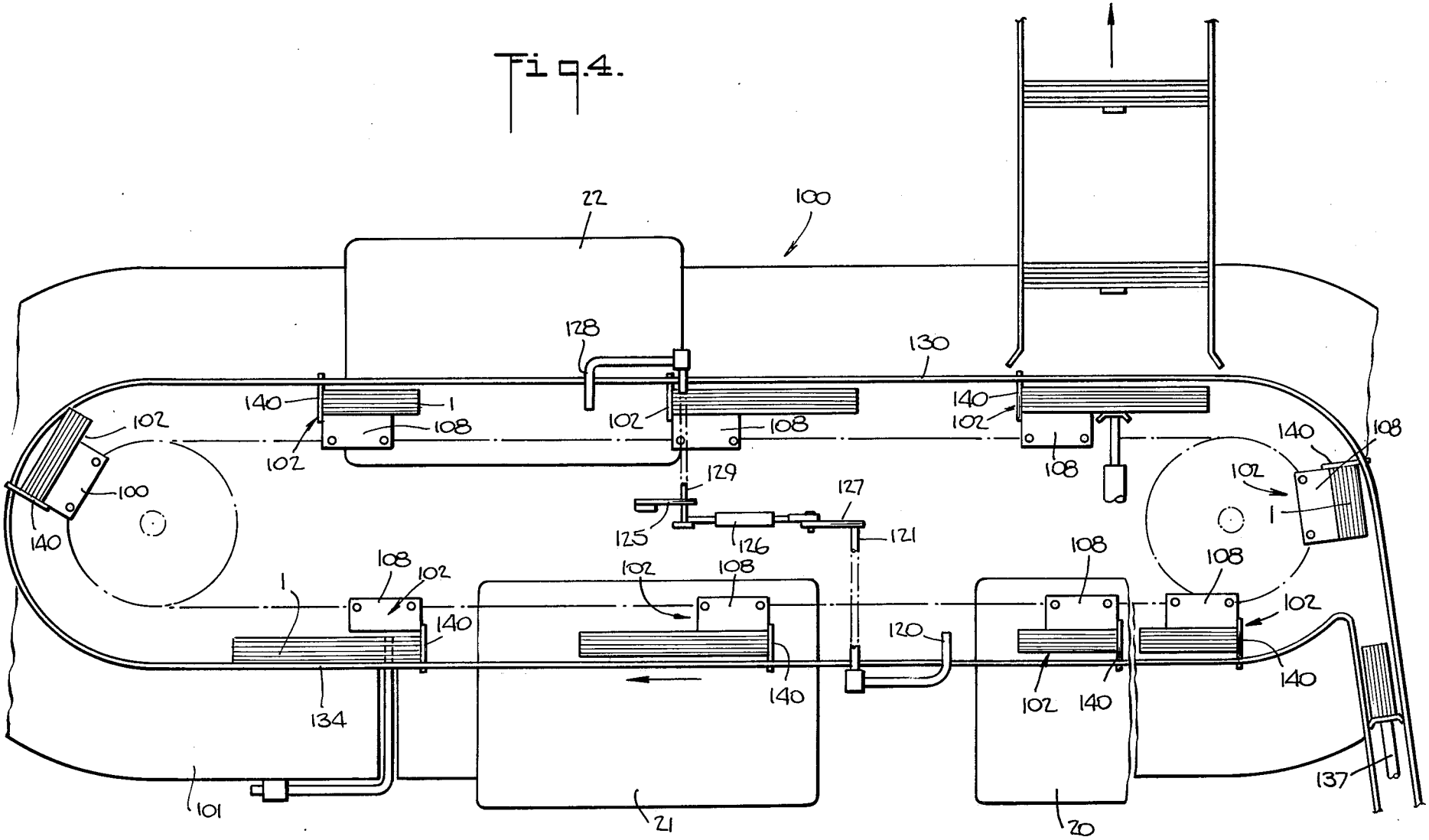
FIG. 4 is a top plan view of the machine of the present invention.
Figure 5:
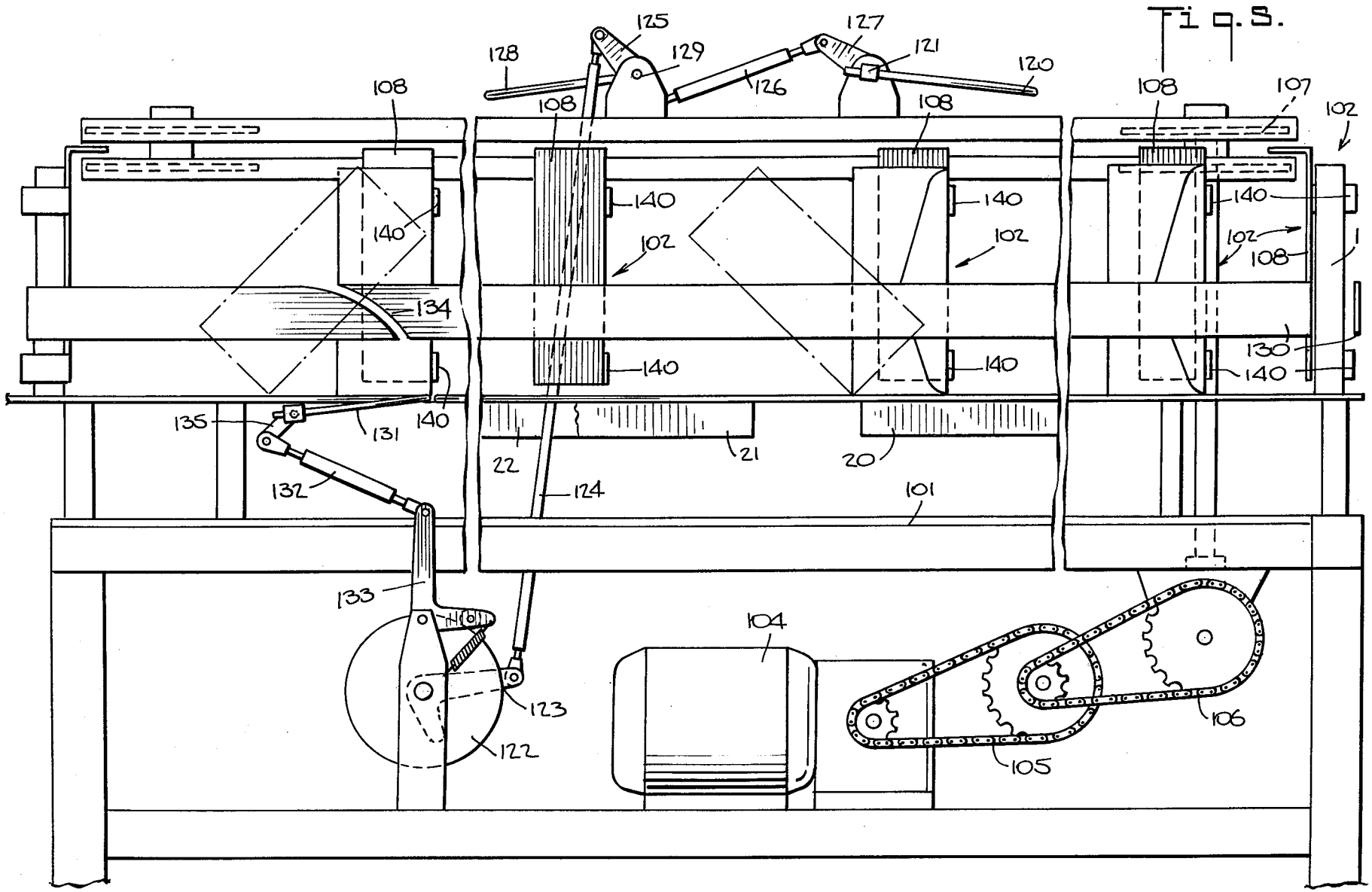
FIG. 5 is a side elevational view.
Figure 6:
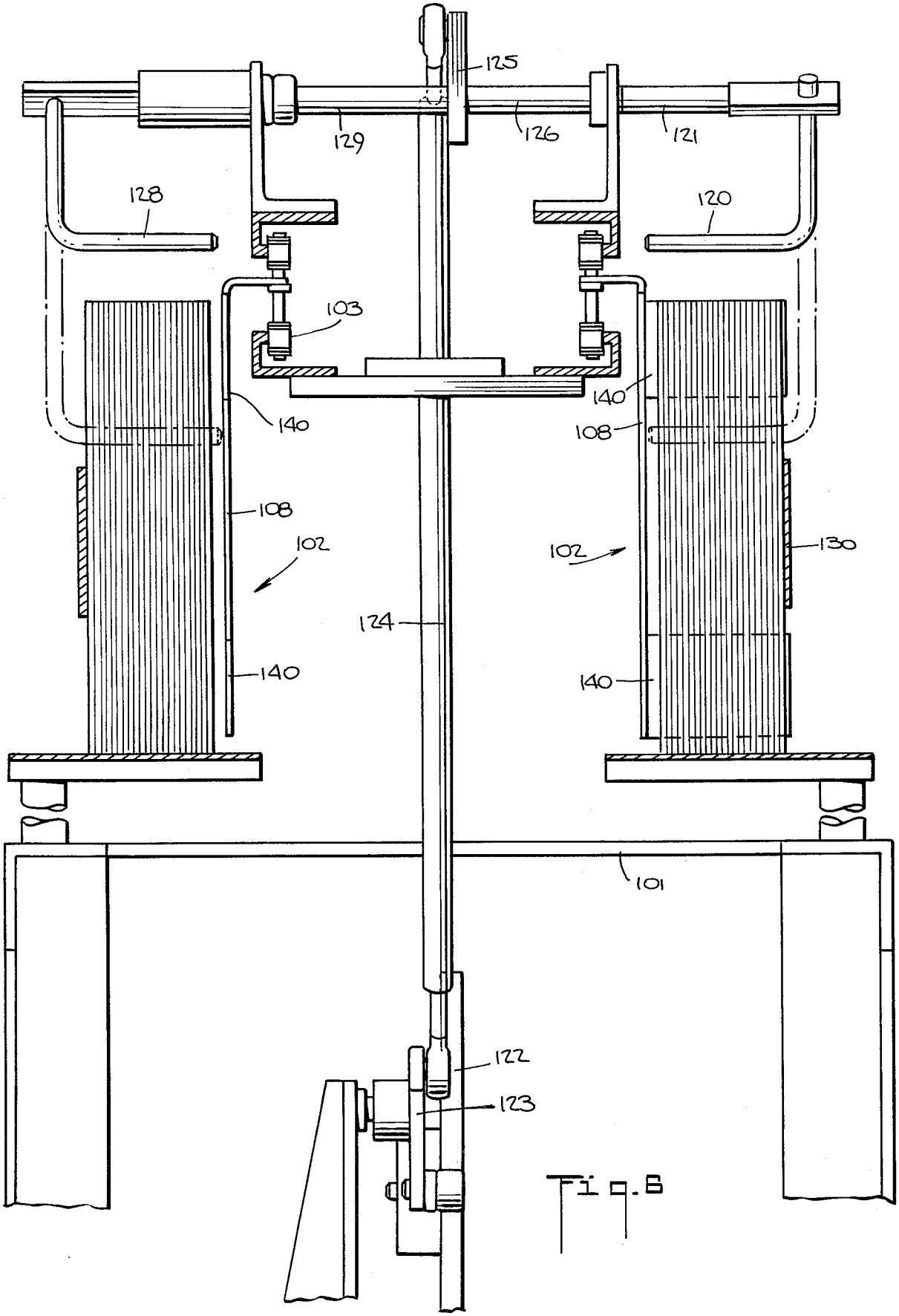
FIG. 6 is an end view of the machine.
Figure 7:
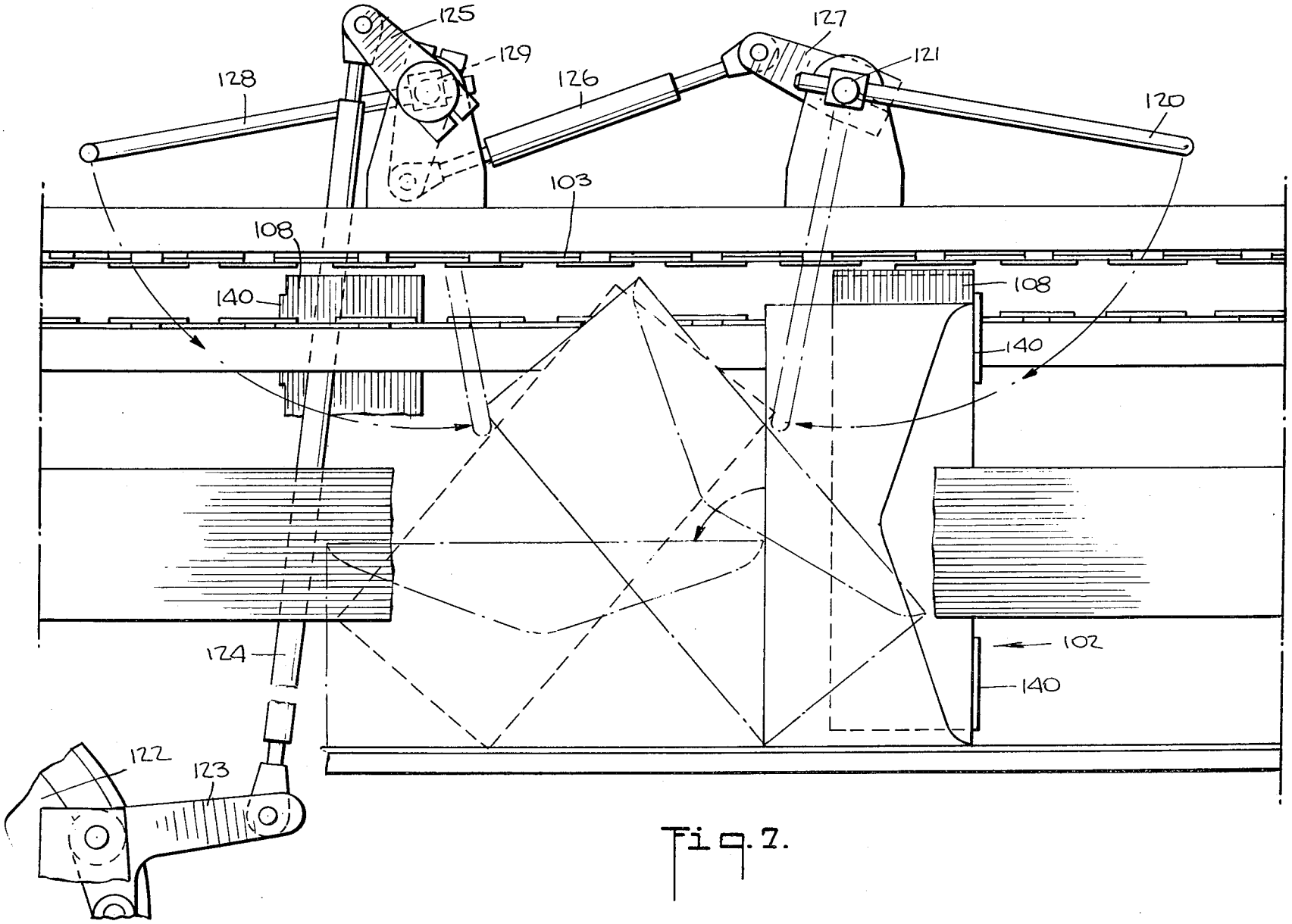
FIG. 7 is an enlarged detail showing the envelope rotating means.

Referring more particularly to FIG. 1, there is shown an envelope 1 which may be used with the present invention. The envelope 1 comprises the usual rear and front panels 2 and 3, respectively, and a gummed flap 4 to seal the contents of the envelope therewithin.

The envelope comprises a pair of end edges 5 and 6 and top edge 8 and bottom edge 7, respectively. In the preferred embodiment of the invention, the paper deteriorating chemicals are applied to both panels 2 and 3 along three zones 15, 16 and 17 adjacent to three edges which, as shown in FIG. 1, are the two end edges 5 and 6 and the bottom edge 7. However, the chemicals may be applied to any three edges and may also be applied to all edges, if desired. In addition, the entire envelope may be coated with the chemicals.

In U.S. Pat. No. 3,677,460 the sensitizing agent consists of a phosphate such as alkyl sodium sulfate and the developing agent comprises an organic acid such as tartaric acid or oxalic acid.

The chemicals used herein may be sodium propyl sulfate for the sensitizing chemical and 2½% tartaric acid for the developing chemical.

In addition to tartaric acid as the developing agent, oxalic acid, maloni and maleic acid will also work although tartaric acid appears to be the preferable form to use. The most common form of tartaric acid is d-tartaric acid which is a by-product of the wine industry and which can be purchased at relatively pure grade (Macalester-Bicknell TX15 Tartaric Acid, N.F., Crystals). If other acids are to be used, then the solution will be 10% for oxalic acid and 8% for malonic or maleic acid. All of these solutions are soluble in propanol or in water although propanol solution may work, it appears important that some water be available for the hydrolysis of sodium n-propyl sulfate. The amount of water naturally absorbed in water may be sufficient but if it is not, some water may be added to the propanol solution.

If alkyl sodium sulfate is used, the lower molecular weight alkyl compounds, such as n-propyl and hexyl compounds are preferred over the higher weights. One example of a usable higher molecular weight compound is sodium lauryl sulfate which is a dodecyl compound available in the trade in "Stepanol WA" and "duponol WAQ". The compound of choice is n-propyl sodium sulfate. It may be present to the extent of 10% in an isopropyl alcohol solution which may also comprise about 10% water.

These chemicals may be applied at the time the envelope is manufactured or may be applied to the envelope at a later date. For example, the sensitizing agent can be applied at the time the envelope is manufactured and the developing chemical can be applied at a subsequent time before the heat is applied and the envelope is to be opened.

Alternatively, the chemicals can be applied one on top of each other at the time it is manufactured or at some time thereafter.

Alternatively, the developing chemicals and the sensitizing chemicals may be mixed together in a batch and the mixture applied to the three edges of the envelope or the chemicals may be applied to the entire paper from which the envelope is made. Whichever method is used to apply the chemicals, application of heat to the three edges will activate the chemicals so that they react to each other and will initiate the paper deteriorating process which opens the three edges of the envelope as shown in FIG. 3.

Referring to FIG. 2 of the drawing, a batch of envelopes are moved along heating plates 20, 21 and 22, which are shown as solid plates. The heating plates 20 to 22 are heated to a temperature sufficient to cause reaction to the sensitizing and developing chemicals along the zones 15 to 17 regardless of when the chemicals were applied thereto.

The envelopes are fed to the heating plate 20 so that one edge, such as end edge 5, rests on and is moved across the heating plate 20 so that the edge receives sufficient heat. After the batch of envelopes move over the heating plate 20, they are rotated 90° so the bottom edge 7 now passes over the second heating plate 21. In this position, the envelopes are then moved across the plate 21 in sufficient amount of time for the reactions to occur. The batch of envelopes are then rotated another 90° so that the last edge 6 is moved over the last heating plate 22.

All three zones 15 to 17 have now been activated and the envelopes may, if desired, be rotated another 90° to the position shown in FIG. 3, in which position the envelopes may be opened and the contents removed.

As shown in the drawings, the envelopes are moved in a continuous circular path which will now be described.

The machine 100 of the present invention comprises a frame 101 and a plurality of envelope holding pocket assemblies 102 which are moved in an oval path by an endless chain assembly 103 mounted to the frame 101. The chain assembly 103 moves the pocket assembly with the envelopes therein over the stationary heaters 20, 21, and 22. The chain 103 is driven by a motor 104 through gear and chain assembly 105 and 106.

The moving pockets 102 move the envelope batch over a first heater 20 which heats the end edge 5 of the envelope.

The envelope batch is then moved past a pivoted finger 120 which is adapted to swing down in order to strike the envelope batch and rotate it 90° to move it down to the side position so that the edge 7 moves over heater 21.

The finger 120 is in the form of a lever depending from shaft 121 which is controlled by a rotating timing wheel 122 through cantilever 123, arm 124, cantilever 125, arm 126 lever 127, and shaft 127*a*.

A similar (pivotally mounted finger 128 mounted on shaft 129 on the other side of the machine and adapted to swing down synchronously with the first finger 120. The finger 128 is controlled by timing wheel 122 by means of arm 124, cantilever 125, and shaft 129 so that a single rotation of the timing wheel 122 will move both fingers 120 and 128 downwardly to strike both batches of envelopes rotate them downwardly 90° and place them in a downward position.

When the envelope batch is turned downwardly by finger 128, it is moved over second heater 21 which applies heat to the long edge 7. After this is accomplished, a raising finger 131 which is mounted below the moving envelopes and is moved upwardly to strike the envelopes batch turn it 90° to an upright position so that heat can be applied to the third edge 6 by third heater 22. This finger 131 is controlled by timing wheel 12 through a link 132–135 and cantilever 133 so that all three fingers 120, 128 and 131 are moved in timed relationship to each other as the timing wheel 122 rotates.

A rail 130 is provided along the outer perimeter of the frame to maintain the envelope batch in their proper relationship within the holders 102. There is a break 134 in the rail 130 to permit the finger 131 to move upwardly through the rail 130 and to strike the envelope batch.

In this raised position, the envelope batch is moved around the bend in the machine and over the third heater 22 which applies heat to the third end edge 6. The envelope batch then moves to a position where the second upper finger 128 pivots downwardly to rotate the envelopes 90° to a downward position along edge 8 so that they can be opened in this position as shown in FIG. 3.

The envelope batch are then moved to an ejection area where the envelopes are ejected by a plunger 136. The envelopes may be placed in the open end of the pockets assemblies 102 at the start of the cycle by a plunger 137, if desired.

Each pocket assembly 102 as shown herein comprises a pair of U-shaped elements 140 depending from chain 103 by means of plate 108 above each other which are adapted to hold the upright envelopes at the top and at the bottom. The pocket assembly 102 holds the envelopes loosely to permit them to drop by gravity onto the heaters 20, 21 and 22. The lower unit 100 is positioned so as to hold and move the envelope batch when the envelopes are in their reclining position moving on their long edges.

It will thus be seen that the present invention comprises an improved machine for opening the envelopes in a continuous, positive and expeditious manner and which does not involve great losses of heat nor require manual handling of the envelopes.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

What is claimed is:

1. A machine for applying heat to the edges of envelopes having sensitizing and developing agents thereon which comprises a frame, a conveyor means, first, second and third heaters mounted on said frame in proximity to the conveyor, envelope moving means mounted on the conveyor means to move envelopes relative to said heaters, said moving means adapted to move one edge of the envelope over said first heater to apply heat thereto, means on said frame for rotating the envelope 90° to rest a second edge of said envelope on said second heater, said moving means adapted to move said second edge over the second heater to apply heat thereto, means on said frame for rotating the envelopes 90° to rest a third edge of said envelope on said third heater, said moving means adapted to move the third edge over said third heater to apply heat to said third edge, whereby the heat applied will deteriorate the said edges.

2. A machine as claimed in claim 1 wherein a first envelope rotating member is provided to strike the envelopes after passing the first heater to rotate them downwardly 90°.

3. A machine as claimed in claim 2 wherein a second envelope rotating member is provided to strike the envelopes after passing the second heater to rotate them upwardly.

4. A machine as claimed in claim 3 wherein said first and second rotating members are movable synchronously with each other.

5. A machine as claimed in claim 4 wherein said envelope moving means comprises an open envelope holding pocket assembly into which the envelopes are deposited.

6. A machine as claimed in claim 5 wherein said open pocket assembly depends from the conveyor.

7. A machine as claimed in claim 6 wherein said conveyor is a chain movable by a drive means and wherein the pocket assembly depends from said chain.

8. A machine as claimed in claim 7 wherein said pocket assembly comprises a pair of U-shape brackets mounted above each other.

9. A machine as claimed in claim 8 wherein said first envelope rotating member is a pivoted finger mounted above said conveyor and adapted to pivot downwardly to strike the envelope and move to a lowered position.

10. A machine as claimed in claim 9 wherein the second envelope rotating member is a pivot finger mounted below said conveyor and movable upwardly to strike the envelope and move it to a raised position.

11. A machine as claimed in claim 10 wherein the two pivot fingers are movable by a common timing wheel.

12. A machine as claimed in claim 11 wherein said two pivot fingers are movable from crank levers mounted on the timing wheel through linkage means extending from the crank levers.

13. A machine as claimed in claim 12 wherein means are provided after the third heater to pivot the envelopes 90° to a downward position.

14. A machine as claimed in claim 13 wherein said means comprises a third pivot finger mounted above said conveyor and pivotable downwardly to strike the envelopes.

15. A machine as claimed in claim 14 wherein said third pivot finger is movable in synchronism with the first and second pivot fingers.

16. A machine as claimed in claim 15 wherein the third finger is movable by the same crank lever and linkage as the first pivot finger.

17. A machine as claimed in claim 16 wherein unloading means are provided to move the envelopes out of the pockets after they are moved downwardly by the third pivot finger.

18. A machine as claimed in claim 17 wherein said unloading means comprise pusher means.

19. A machine as claimed in claim 18 wherein loading means are provided for moving envelopes into the pockets.

20. A machine as claimed in claim 19 wherein said loading means comprise pusher means.

21. A machine as claimed in claim 20 wherein a rail is provided along the outside of the machine to guide envelopes.

22. A machine as claimed in claim 21 wherein there is a slot in the rail through which said second finger moves to strike the envelopes.

23. A machine as claimed in claim 22 wherein said batches are loosely held in the pockets so that the edges will drop on to the heaters.

24. A mechanism as claimed in claim 23 wherein the movement of the envelopes is continuous in an oval path.

25. A mechanism as claimed in claim 24 wherein the heaters are solid plates against which the edges are moved.

26. A mechanism as claimed in claim 25 wherein said sensitizing agent comprises alkyl sodium sulfate.

27. A mechanism as claimed in claim 26 in which said sensitizing agent comprises a lower molecular weight alkyl sodium sulfate.

28. A mechanism as claimed in claim 27 in which said sensitizing agent comprises n-propyl sodium sulfate.

29. A mechanism as claimed in claim 28 in which said sensitizing agent comprises about a 10 percent solution of n-propyl sodium sulfate.

30. A mechanism as claimed in claim 29 in which said solution comprises a major amount of isopropyl alcohol.

31. A mechanism as claimed in claim 30 wherein said developing agent is an organic acid.

32. A mechanism as claimed in claim 31 wherein said organic acid is selected from the class consisting of oxalic acid and acetic acid.

33. A mechanism as claimed in claim 32 in which said developing compound comprises oxalic acid.

34. A mechanism as claimed in claim 33 in which said developing compound comprises a 10 percent solution of oxalic acid.

35. A mechanism as claimed in claim 34 wherein said sensitizing agent comprises a higher molecular weight alkyl sodium sulfate.

36. A mechanism as claimed in claim 35 wherein said sensitizing agent is sodium lauryl sulfate.

37. A mechanism as claimed in claim 36 in which said developing agent is acetic acid.

38. A mechanism as claimed in claim 37 wherein said developing agent comprises tartaric acid.

* * * * *